US006102084A

United States Patent [19]

Rüegg

[11] Patent Number: 6,102,084

[45] Date of Patent: Aug. 15, 2000

[54] RAPIER CLAMP

[75] Inventor: Robert Rüegg, Hadlikon, Switzerland

[73] Assignee: Sulzer Rueti AG, Rueti, Switzerland

[21] Appl. No.: 09/038,804

[22] Filed: Mar. 11, 1998

[30] Foreign Application Priority Data

Mar. 14, 1997 [EP] European Pat. Off. ..... 97810149

[51] Int. Cl.[7] ..... D03D 47/23

[52] U.S. Cl. ..... 139/448; 24/130

[58] Field of Search ..... 24/130; 139/448, 139/447, 170.3

[56] References Cited

U.S. PATENT DOCUMENTS 4,708,174 11/1987 Vandeweghe et al. ..... 139/448
5,558,133 9/1996 Bortoli et al. ..... 139/448

FOREIGN PATENT DOCUMENTS 0 115 238 8/1984 European Pat. Off. .
0 207 533 1/1987 European Pat. Off. .
0 584 429 A1 3/1994 European Pat. Off. .
1.571.925 6/1969 France .

*Primary Examiner*—Andy Falik
*Attorney, Agent, or Firm*—Townsend and Townsend and Crew LLP

[57] ABSTRACT

A rapier clamp for an inserting rapier of a rapier weaving machine. The rapier clamp includes a first and a second holding member that are pivotally arranged with respect to one another and are in resiliently pre-biased contact. Between oppositely disposed surfaces of the holding members is spacing structure for creating a free space for receiving a weft thread. Holding sections for the weft thread are formed on the opposing surfaces of the two holding members and the holding sections include at least partially inter-engaging tooth grooves that extend along a longitudinal extent of the holding members.

5 Claims, 2 Drawing Sheets

RAPIER CLAMP

BACKGROUND OF THE INVENTION

1. Field of the Invention

The invention relates to a rapier clamp for an inserting or bringer rapier and to a rapier weaving machine with a rapier clamp.

2. Description of the Prior Art

Are known which have a first and a second clamping member which are pivotally arranged relative to one another about a common axis in order to clamp a weft thread and which have a spring which biases the clamping members towards one another and produces the clamping force. The two clamping members form an entry gap and an adjoining clamping section within which the weft thread is clamped.

It proves disadvantageous that such rapier clamps have a clamping location which is loaded by spring force, due to which the thread is relatively strongly stressed and the insertion of differently structured threads under the same clamping force is greatly restricted.

SUMMARY OF THE INVENTION

The object of the present invention is to improve the known rapier clamps in such a manner that the disadvantages are eliminated.

In the present invention, the rapier clamp includes first and second holding members that are in resilient contact with structure provided for creating a free space for receiving weft threads between oppositely disposed surfaces.

The advantages which can be achieved with the invention are essentially to be seen in the fact that the pressure load on the weft thread to be inserted is restricted to a minimum.

DESCRIPTION OF THE PREFERRED EXEMPLARY EMBODIMENTS

Figure 1:
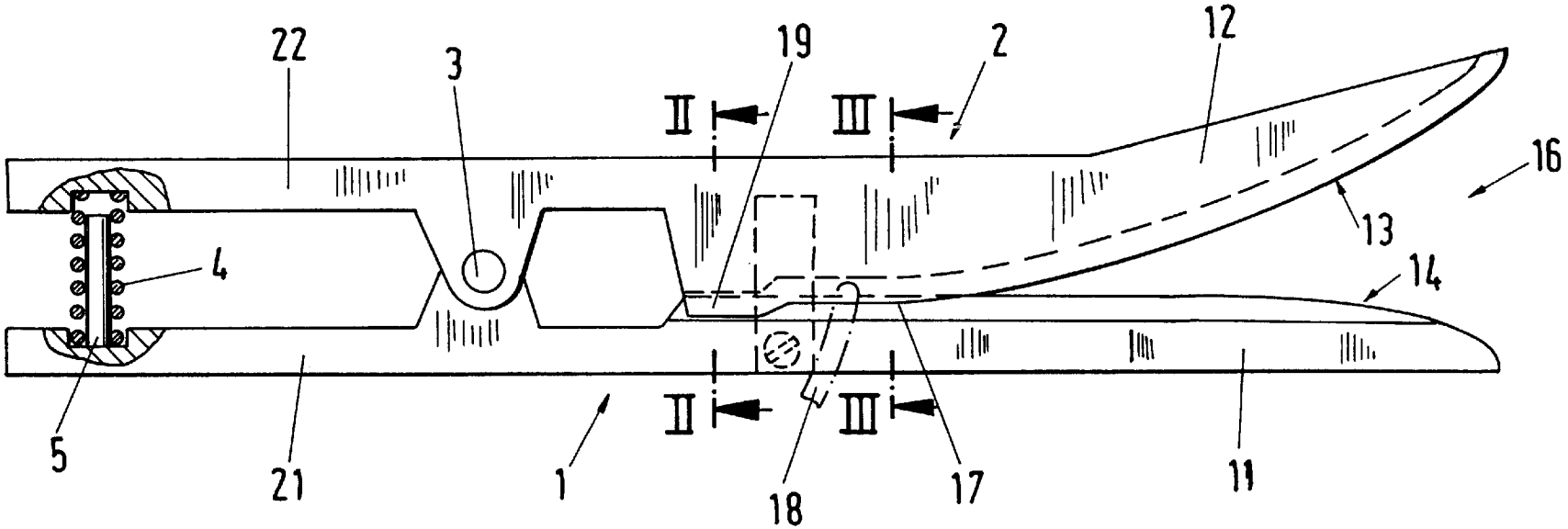
FIG. 1, a side view of a first embodiment of a rapier clamp in accordance with the invention, with a thin thread being held.
Figure 3:
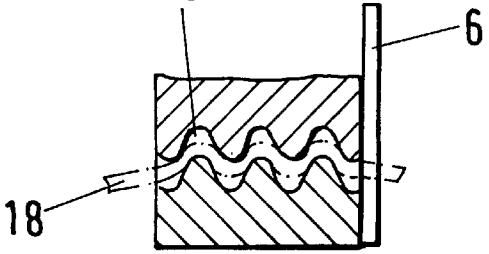
FIG. 3, a section along the line III—III in FIG. 1.
Figure 2:
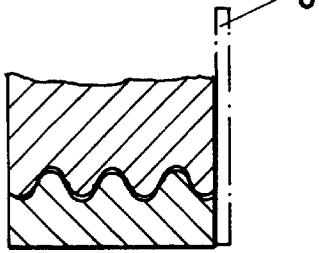
FIG. 2, a section along the line II—II in FIG. 1.

Reference is made to FIGS. 1 to 3. The rapier clamp contains a first and a second holding member 1 and 2, a joint pin 3, a restoring spring 4 and an abutment member 5. The first and second holding members 1, 2 are executed as two armed levers and connected to one another by means of the joint pin 3, with the first holding member 1 being arranged in a fixed position and the second holding member 2 being pivotally arranged with respect to the first one.

The one lever arm pair 11, 12 is provided on the oppositely disposed surfaces 13, 14 with tooth grooves 15 which are formed in the longitudinal extent of the lever arms 11, 12 and inter-engage (FIGS. 2 and 3). This lever arm pair 11, 12 forms, beginning at the free end, an entry section 16 with diminishing gap width, a holding section 17 with largely constant gap width for the weft thread 18 and a section 19 in which the oppositely disposed surfaces of the lever arms 11, 12 lie one upon the other as is shown in FIG. 2. In order to achieve this, the section 19 on the lever arm 12 of the second holding member 2 is formed as a projection. The restoring spring 4 is arranged between the lever arms 21, 22 of the other lever arm pair and holds the oppositely disposed surfaces of the section 19 of the one lever arm pair 11, 12 in resiliently biased contact (FIG. 2). The abutment member 5 is arranged in the restoring spring 4 and intended for the limitation of the pivotal movements which can be executed by the other lever arm pair 21, 22 and thus at the same time the compression of the spring 4. A member 6 can be fastened to the rapier clamp in order to limit the depth of penetration of a weft thread 18 into the rapier clamp. In the place of the projection 19 a support part can be attached to a surface 13, 14.

Figure 4:
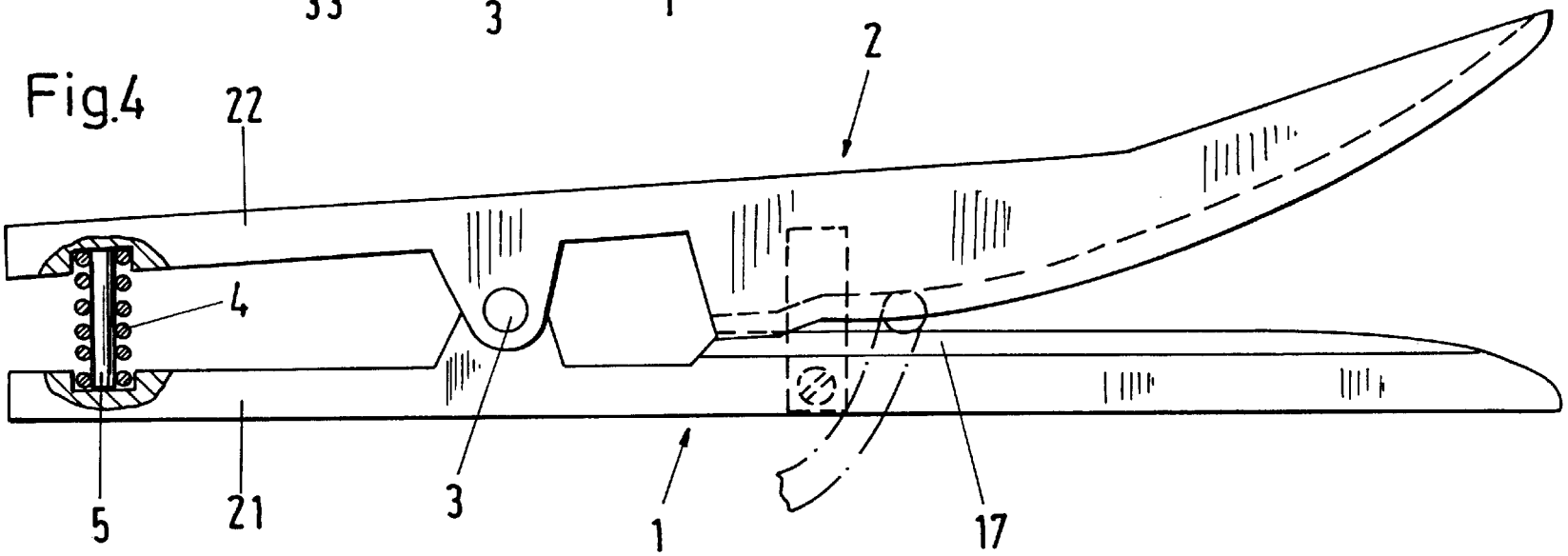
FIG. 4, a side view as in FIG. 1, with a thick thread being held.

As can be seen in FIGS. 1 and 4, weft threads of differing thicknesses or structuring can be held by the rapier clamp under discussion here. A corresponding design of the gap width in the holding section 17 and of the spring force has the result that a correspondingly thin weft thread 18 is held merely by the wrapping friction, i.e. by the frictional engagement with the profiled surface, without clamping. For a thick weft thread, a spring action is produced by means of the spring 4 for the assistance or augmentation of the wrapping friction. Finally, the rapier clamp acts as a so-called wedge clamp if the lever arms 21, 22 lie in contact with the spacer 5.

Figure 5:
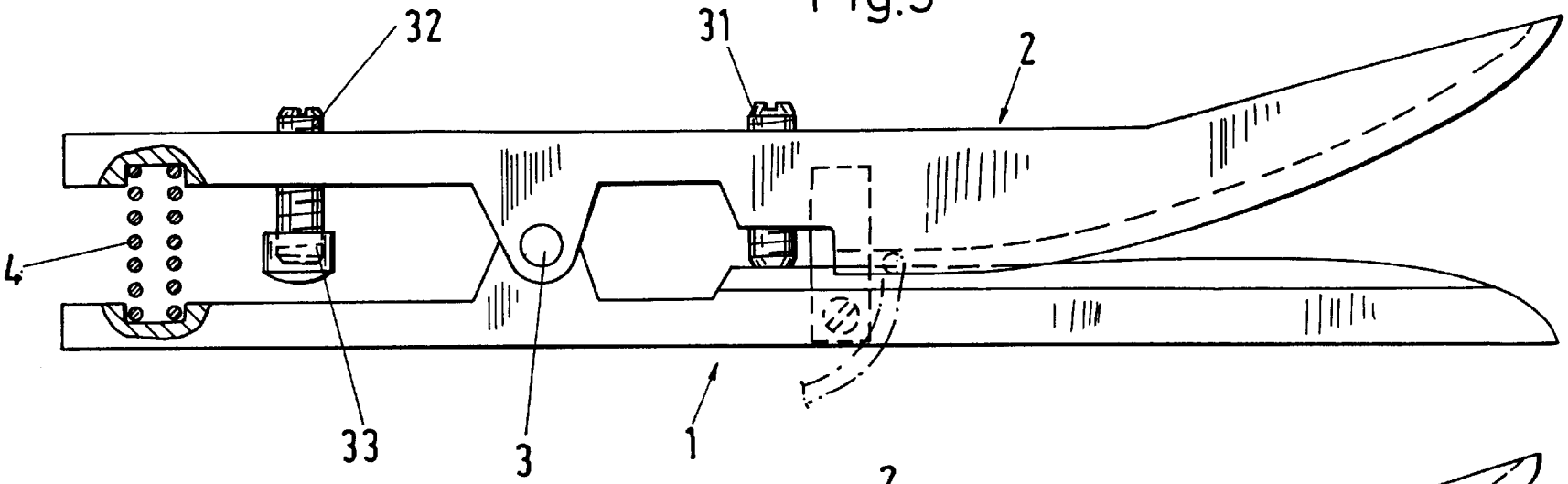
FIG. 5, a side view of a second embodiment of the rapier clamp in accordance with the invention.

FIG. 5 shows an embodiment of the rapier clamp with adjustable gap width. An adjustment screw 31 is provided for the adjustment of the minimum gap width in the holding section 17 and an adjustment screw 32 is provided for the adjustment of the maximum gap width. The adjustment screw 32 is provided with a damping member 33, for example of plastic.

The rapier clamp contains a first and a second holding member 1, 2 which are pivotally arranged with respect to one another and are in resiliently pre-biased contact. Between the oppositely disposed surfaces of the holding members 1, 2 is a spacing means 19 in order to create a free space 15 formed by the tooth grooves for receiving the weft thread.

What is claimed is:

1. A rapier clamp for an inserting rapier of a rapier weaving machine, the rapier clamp comprising:

a first and a second holding member that are in resilient contact; and means for creating a free space between oppositely disposed surfaces of the holding members for receiving a weft thread;

wherein the first and second holding members are executed as two armed levers and are pivotal relative to one another about a common axis;

wherein holding sections for the weft thread are formed on the opposing surfaces of the two armed levers; and wherein the holding sections include at least partially inter-engaging tooth grooves that extend along a longitudinal extent of the lever arms.

2. A rapier clamp in accordance with claim 1 wherein the means for creating a free space comprises a projection formed on a surface of at least one holding member.

3. A rapier clamp in accordance with claim 1 wherein an intermediate part is arranged between the surfaces of the holding members.

4. A rapier clamp in accordance with claim 1 wherein the means for creating a free space comprises a setting member for adjusting the free space.

5. A rapier weaving machine comprising an inserting rapier that includes a rapier clamp, the rapier clamp comprising:

a first and a second holding member that are in resilient contact; and means for creating a free space between oppositely disposed surfaces of the holding members for receiving a weft thread;

wherein the first and second holding members are executed as two armed levers and are pivotal relative to one another about a common axis;

wherein holding sections for the weft thread are formed on the opposing surfaces of the two armed levers; and wherein the holding sections include at least partially inter-engaging tooth grooves that extend along a longitudinal extent of the lever arms.

* * * * *